US006488410B2

(12) United States Patent
Schneider

(10) Patent No.: US 6,488,410 B2
(45) Date of Patent: Dec. 3, 2002

(54) TAMPER-EVIDENT RECLOSABLE PACKAGING WITH SLIDE/ZIPPER ASSEMBLY AND HEADER

(75) Inventor: John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/975,758

(22) Filed: Oct. 11, 2001

(65) Prior Publication Data

US 2002/0094138 A1 Jul. 18, 2002

Related U.S. Application Data

(63) Continuation-in-part of application No. 09/761,500, filed on Jan. 16, 2001.

(51) Int. Cl.[7] ..... B65D 33/34

(52) U.S. Cl. ..... 383/5; 383/64; 383/203; 383/210; 53/412

(58) Field of Search ..... 383/5, 64, 203, 383/210, 211, 61.2, 61.3; 24/399, 400; 53/412; 493/213

(56) References Cited

U.S. PATENT DOCUMENTS

| | | | | |
|---|---|---|---|---|
| 4,923,309 A | | 5/1990 | VanErden | |
| 4,925,316 A | | 5/1990 | VanErden et al. | |
| 5,470,156 A | | 11/1995 | May | |
| 5,474,382 A | | 12/1995 | May | |
| 5,480,230 A | * | 1/1996 | May | 383/203 |
| 5,486,051 A | | 1/1996 | May | |
| 5,492,411 A | | 2/1996 | May | |
| 5,509,735 A | | 4/1996 | May | |
| 5,513,915 A | | 5/1996 | May | |
| 5,551,127 A | | 9/1996 | May | |
| 5,604,000 A | | 2/1997 | May | |
| 5,672,009 A | | 9/1997 | Malin | |
| 5,713,669 A | | 2/1998 | Thomas et al. | |
| 5,725,312 A | | 3/1998 | May | |
| 5,775,812 A | * | 7/1998 | St. Phillips et al. | 383/5 |
| 5,827,163 A | | 10/1998 | Kettner | |
| 5,930,877 A | | 8/1999 | Thorpe et al. | |
| 5,964,532 A | | 10/1999 | St. Phillips | |
| 6,247,843 B1 | * | 6/2001 | Buchman | 383/202 |
| 6,286,999 B1 | * | 9/2001 | Cappel et al. | 24/400 |

* cited by examiner

*Primary Examiner*—Jes F. Pascua
(74) *Attorney, Agent, or Firm*—Ostrager Chong & Flaherty LLP

(57) ABSTRACT

A reclosable packaging having a slider/zipper assembly, a header and a tamper-evident feature which undergoes a tangible change when the slider is moved relative to the header for the first time. The tamper-evident feature comprises a layer of sticky or adhesive material placed between a surface of the header and an opposing surface of the slider, thus forming a seal. The material must have a peel strength or resistance to rupture sufficient to resist an initial movement of the slider along the zipper. If the slider is stuck or adhered to the header, this indicates that the package or bag has not been tampered with, i.e., previously opened. When sufficient force is applied, the seal can be broken, allowing the slider to move relative to the header along the zipper in the direction of opening. Once broken, the seal cannot be restored by simply returning the slider to its original position and pressing the slider against the sticky or adhesive material. Thus the slider remains in an unsealed state which is readily detectable by the consumer, thereby providing a tangible indication that the package has been previously opened.

22 Claims, 3 Drawing Sheets

TAMPER-EVIDENT RECLOSABLE PACKAGING WITH SLIDE/ZIPPER ASSEMBLY AND HEADER

RELATED PATENT APPLICATION

This application is a continuation-in-part application claiming priority from U.S. patent application Ser. No. 09/761,500 filed on Jan. 16, 2001.

FIELD OF THE INVENTION

The present invention relates to reclosable packaging and in particular to such packaging wherein indicia are provided to indicate the first opening of the package.

BACKGROUND OF THE INVENTION

In the use of plastic bags and packages, particularly for foodstuffs, it is important that the bag be hermetically sealed until the purchaser acquires the bag and its contents, takes them home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper is one which has a groove at one side of the bag mouth and a rib at the other side, which rib may interlock into the groove when the sides of the mouth of the bag are pressed together. Alternatively, a member having a plurality of ribs may be on one side of the bag mouth, while a member having a plurality of channels may be on the other side, the ribs locking into the channels when the sides of the mouth of the bag are pressed together. In such a case, there may be no difference in appearance between the two members, as the ribs may simply be the intervals between channels on a strip which may lock into another of the same kind. In general, and in short, some form of male/female interengagement is used to join the two sides of the bag mouth together. The so-called members, or strips, are bonded in some manner to the material from which the bags themselves are manufactured. Usually, pull flanges extend above the rib and groove strips, which pull flanges may be pulled apart for access to the interior of the bag.

Although flexible zippers of this variety are quite popular, they do not always prevent the inadvertent or unwelcome opening of a bag or package within the store, and various additions have been made to provide tamperevident seals which would reveal when it has been opened prior to purchase. The problem of providing a tamper-evident zipper is exacerbated in package designs wherein the zipper is provided with a slider. While a slider facilitates a consumer opening and reclosing the package and hence is desirable in some instances, the slider makes it difficult for the manufacturer to employ conventional techniques to render the package tamper evident.

It is known to provide a zipper package construction which is designed to undergo some permanent change in the package appearance when the package is opened for the first time. In particular, it is known to provide a zipper package with a tamper-evident, non-reclosable peel seal which gives a positive indication of having been broken when a package is first opened and which is non-reclosable after being first opened.

Such zipper package constructions should also have other desirable features. For example, the package should be "user friendly" in the sense that the steps necessary for the initial opening of the package prior to the use of the zipper are obvious or intuitive to the consumer. Also the zipper package design should allow the package to be formed on conventional packaging equipment with little or no modification of the equipment being required. In cases where the zipper packaging includes a slider, the tamperevident feature should be compatible with the slider. Similarly, where the package contents require hermetic sealing, it is desirable that the tamper-evident feature also permit such hermetic sealing.

SUMMARY OF THE INVENTION

The present invention is directed to a reclosable packaging having a slider/zipper assembly, a header and a tamper-evident feature which undergoes a tangible change when the slider is moved relative to the header for the first time. The tamper-evident feature comprises a layer of sticky or adhesive material placed between a surface of the header and an opposing surface of the slider, thus forming a seal. The material must have a peel strength or resistance to rupture sufficient to resist an initial movement of the slider along the zipper. If the slider is stuck or adhered to the header, this indicates that the package or bag has not been tampered with, i.e., previously opened. When sufficient force is applied, the seal can be broken, allowing the slider to move relative to the header along the zipper in the direction of opening. Once broken, the seal cannot be restored by simply returning the slider to its original position and pressing the slider against the sticky or adhesive material. Thus the slider remains in an unsealed state which is readily detectable by the consumer, thereby providing a tangible indication that the package has been previously opened.

The reclosable packaging incorporating the foregoing feature may comprise a front wall, a rear wall opposite to the front wall, a bottom wall connecting the bottom edges of the front and rear walls, and left and right side walls connecting opposing side edges of the front and rear walls and also connected to the bottom wall. However, the tamper-evident feature disclosed herein may also be used in pouches or bags having other shapes, e.g., bags with no bottom or side panels and the bottom and side edges of the front and rear walls heat sealed together; and so forth. The zipper typically comprises a pair of complementarily profiled, extruded plastic fastener strips. The first fastener strip comprises a first interlockable member having a first profile and is attached to the front wall of the packaging; the second fastener strip comprises a second interlockable member having a second profile and is attached to the rear wall of the package. The second interlockable member is interlocked with the first interlockable member for closing the top of the package. A slider is slidably positioned over the interlockable portions of the fastener strips for movement along the zipper from side to side of the package. The slider causes the profiled interlockable members to disengage when moved in the direction of the closing end of the slider, allowing access to the contents of the package, and causes the profiled interlockable members to interlock when moved in the direction of the opening end of the slider.

In accordance with one preferred embodiment of the present invention, the slider is initially, i.e., prior to the first opening, constrained by a peel seal comprising a layer of sticky or tacky material placed between the slider and the header. In accordance with another preferred embodiment, the slider is constrained by an adhesive seal comprising a layer of adhesive material. In either case, the seal must be removed or ruptured or delaminated to permit movement of the slider relative to the header and thus provide access to the package contents. As long as the seal is intact, the consumer is assured that the slider has not been previously moved or slid along the zipper. Only during the initial access to the package contents, when the slider is moved relative to the header for the first time, will the integrity of the seal be disrupted. The broken seal produces tangible evidence that the package has been previously opened.

In accordance with a first preferred embodiment of the invention, the header to which the slider is tacked is integrally formed as an extension of the rear wall of the package or bag.

In accordance with a second preferred embodiment of the invention, the header to which the slider is tacked is integrally formed as an extension of the flange of one of the fastener strips.

In accordance with a third preferred embodiment of the invention, the header to which the slider is tacked is formed as a separate piece which is heat sealed or welded to either the rear wall of the package or bag or to the flange of one of the fastener strips.

In accordance with another preferred embodiment of the invention, the tacked slider combinations are further combined with features that provide a hermetically sealed package.

A person skilled in the art will readily appreciate that, instead of applying a layer of sticky or adhesive material on the header or slider, a strip bearing a layer of sticky or adhesive material can be heat sealed or welded to the header or slider.

In each of the above cases, a step that must be taken before the initial opening of the package results in a physical altering of the sealed package which may readily be observed or discovered by a consumer.

Other aspects of the invention are disclosed and claimed below.

DETAILED DESCRIPTION OF THE PREFERRED EMBODIMENTS

Figure 1:
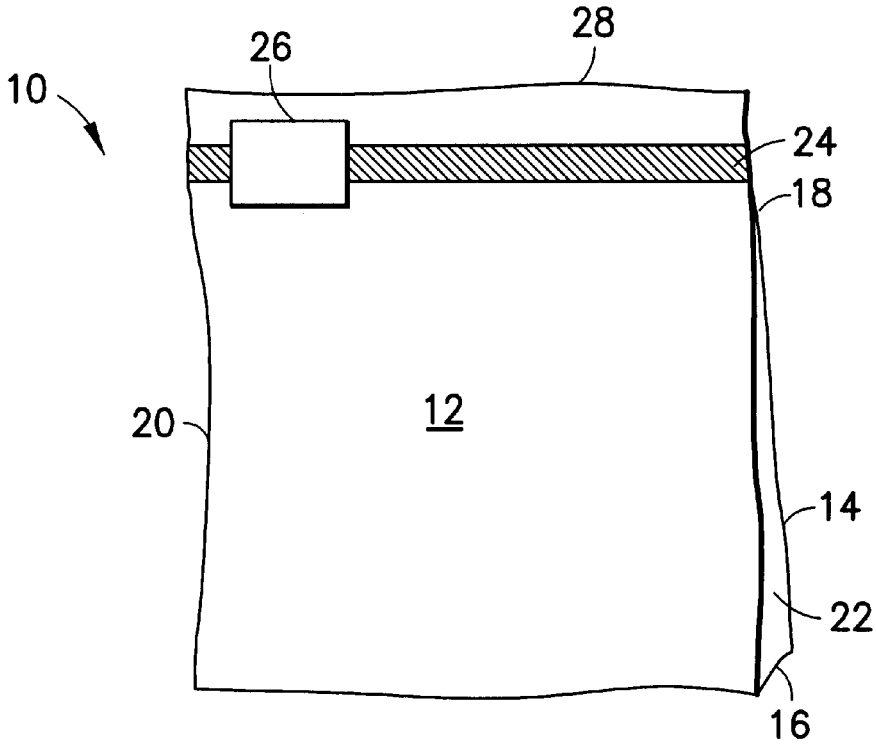
FIG. 1 is a drawing showing a front perspective view of a reclosable package in accordance with the preferred embodiments of the invention.

Reference will now be made to the drawings in which similar members in different drawings bear the same reference numerals. FIG. 1 depicts a reclosable package 10 comprising a front wall 12 and a rear wall 14 that is opposite to the front wall. The package further has a bottom panel 16, a top end 18 and left and right sides 20, 22. The walls, bottom panel and sides are typically formed from thermoplastic film heat sealed as necessary to form hermetically sealed junctures for the various portions of the package. A zipper 24 is provided at the package top end. A slider 26 is provided on the zipper to facilitate its opening and closing. To this end, moving the zipper slider toward one side 22 disengages the interlocking members of the zipper fastener strips and moving the slider toward the opposite side 20 brings the interlockable members of the zipper fastener strips into engagement. The reclosable package shown in FIG. 1 further comprises a header 28, which may be a panel or strip formed from the same material as that comprising the walls of the package or from the same material as that comprising the zipper or from an entirely separate material.

In accordance with preferred embodiments of the present invention, after the package has been filled with product, the zipper is closed by moving the slider 26 to the position shown in FIG. 1. When the slider is in the closed position, a layer of sticky or adhesive material is placed between the slider 26 and the header 28. Alternatively, the layer of sticky or adhesive material can be applied to the header before the slider is moved to the closed position, the material being applied on the surface portion of the header which will oppose the slider in the closed position or on the rear external surface of the slider which faces the header. In either event, when the slider is in the closed position, the sticky or adhesive material will be in contact with both the rear external surface of the slider and the opposing surface portion of the header. The sticky or adhesive material will hold the slider in its closed position until such time that sufficient force is applied to break the seal formed by the sticky or adhesive material. This may be accomplished by prying the header back and away from the slider or by gripping the slider and forcing it to slide laterally along the zipper in the direction of opening.

Figure 2:
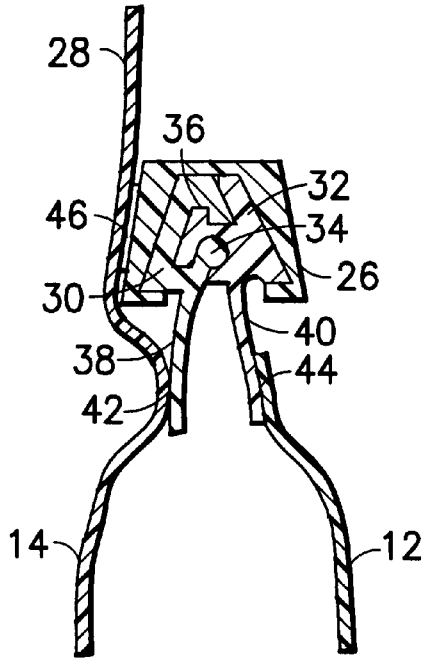
FIG. 2 is a drawing showing a fragmentary sectional view of the zippered portion of a reclosable package in accordance with a first preferred embodiment of the invention.

Referring to FIG. 2, it can be seen that the zipper 24 consists of a first fastener strip 30 and a second fastener strip 32. Fastener strip 30 is provided with a first interlockable member 34 and fastener strip 32 is provided with a second interlockable member 36 that is engageable with the first interlockable member 34. Numerous configurations for the interlockable members 34, 36 are well known in the art. Fastener strip 30 further includes a flange 38 that extends toward the interior of the package and fastener strip 32 further includes a similar flange 40. Flange 38 is attached to package wall 14 by a "hard" seal 42, that is, a seal which is not intended to be broken. Similarly, flange 40 is attached to package wall 12 by a "hard" seal 44. In accordance with the first preferred embodiment shown in FIG. 2, the package wall 14 also includes a portion that extends past and over the seal point 42, and continues beyond the seal point 42 to form the header 28. The header 28 may be provided with an aperture (not shown) for receiving a hook for suspending the package on a display rack.

As seen in FIG. 2, a layer of sticky or adhesive material is placed between a rear external surface of the slider 26 and an opposing area on the front surface of the header 28, forming a seal 46. As long as the seal 28 is unbroken, this indicates that the slider has not been moved from its initial closed position generally depicted in FIG. 1. The seal 46 effectively joins the slider and the header, the rupture resistance of the seal producing a corresponding resistance to lateral displacement of the slider relative to the header and along the zipper axis in the direction of opening. Thus, the fact that the slider 26 is tacked or anchored to the header 28 indicates that the package has not been previously opened, i.e., is free of tampering or pilfering. Once the seal is ruptured or removed, the slider is loosened and able to move relative to the header. This loosened state of the slider serves as an indication that the package may have been previously opened, i.e., tampered with. Preferably graphics are provided on the header or on a wall of the package that indicate the presence of the tamper-evident feature and explain how to use this feature for consumer protection.

Figure 3:
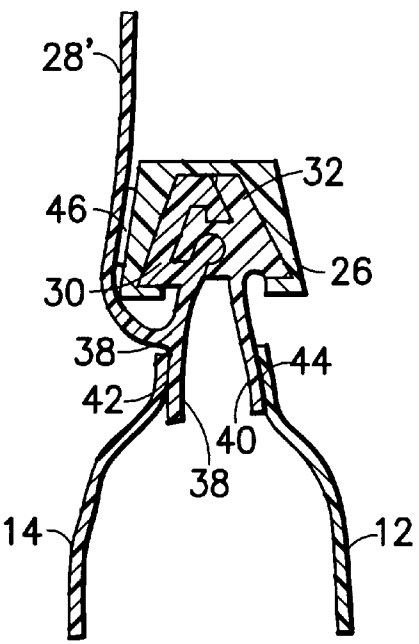
FIG. 3 is a drawing showing a fragmentary sectional view of the zippered portion of a reclosable package in accordance with a second preferred embodiment of the invention.

An alternative preferred embodiment is generally depicted in FIG. 3. The only structural difference between the preferred embodiments respectively shown in FIGS. 2 and 3 is that in the embodiment of FIG. 3, the header 28' is integrally formed as an extension from the flange 38 of the fastener strip 30, whereas in FIG. 2 the header 28 is shown as being an extension of the rear wall 14. The header 28' preferably has a thickness which allows the header 28' to flex rearward, away from the slider 26. The consumer can pry the header rearward or move the slider in order to rupture the seal 46, which is again preferably formed by a layer of sticky or adhesive material. During the prying operation, either the seal 46 ruptures or the seal is peeled away from the slider or from the header.

Figure 6:
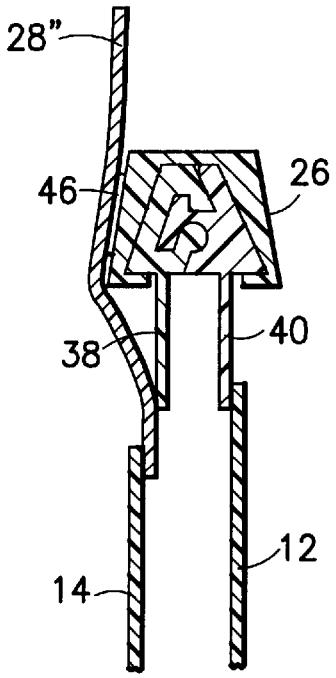
FIGS. 6 and 7 are drawings showing fragmentary sectional views of the zippered portion of reclosable packages in accordance with a third preferred embodiment of the invention.
Figure 7:
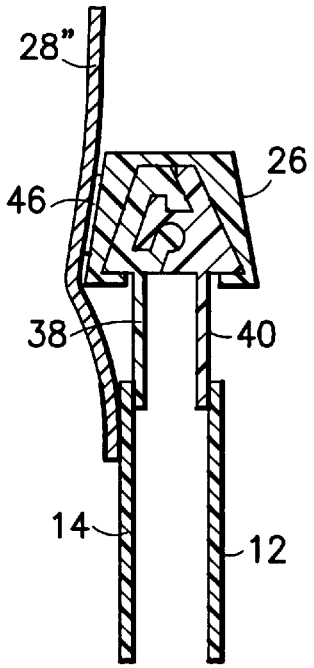

Instead of being integrally formed as an extension of a zipper flange or a package wall, the header may comprise a panel of thermoplastic material which is heat sealed or ultrasonically welded to either a zipper flange or a package wall. Two variations of this embodiment are respectively shown in FIGS. 6 and 7. In the embodiment of FIG. 6, the header 28" is a separate piece of thermoplastic material having a first portion which is preferably heat sealed to wall 14 and having a second portion which is preferably heat sealed to the zipper flange 38. In the embodiment of FIG. 7, the header 28" is a separate piece of thermoplastic material having a portion which is preferably heat sealed to wall 14, which wall is in turn preferably heat sealed to the zipper flange 38. In both cases the slider 26 is tacked or adhered to the header 28" by means of a seal 46 preferably formed by a layer of sticky or adhesive material.

Figure 5:
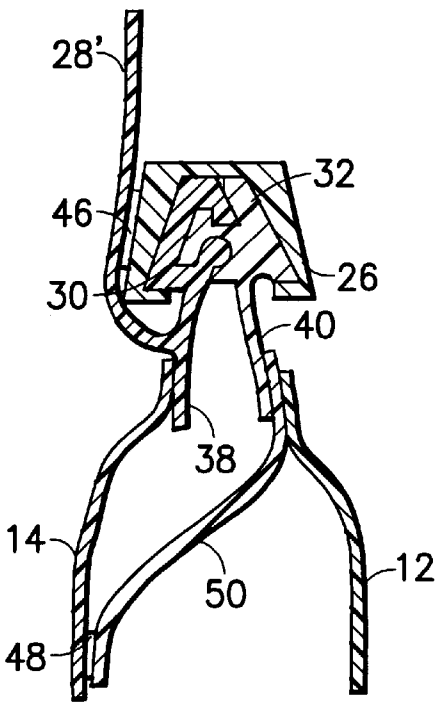
FIG. 5 is a drawing showing a fragmentary sectional view of the zippered portion of a reclosable package of the type shown in FIG. 3 with a hermitic sealing feature added.
Figure 4:
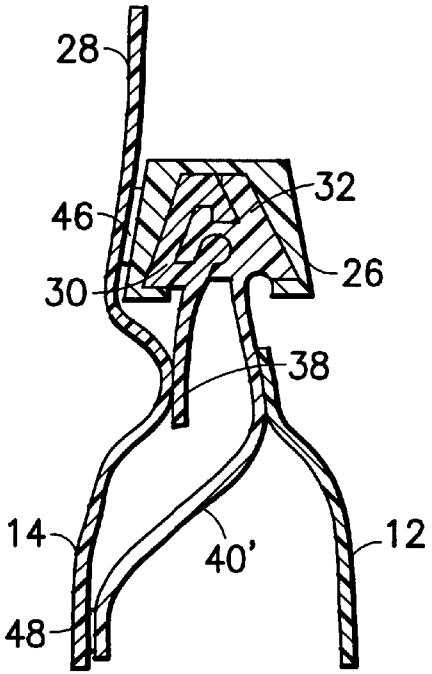
FIG. 4 is a drawing showing a fragmentary sectional view of the zippered portion of a reclosable package of the type shown in FIG. 2 with a hermitic sealing feature added.

As previously noted, the tamper-evident feature disclosed herein also has application in packages comprising front and rear walls heat sealed at their side and bottom edges, i.e., so-called "pillow" package. FIGS. 4 and 5 respectively show the tamper-evident feature in accordance with the first and second preferred embodiments of FIGS. 1 and 2, incorporated in a "pillow" package. In these applications, an optional internal hermetic peel seal may be provided as shown in FIGS. 4 and 5.

FIG. 4 shows a package incorporating the tamper-evident feature of FIG. 2 and an internal hermetic peel seal. The internal hermetic peel seal is provided by extending the flange of the zipper fastener strip 32 to form a web 40'. The distal edge of the web 40' is sealed to the rear wall 14 by means of a layer 48 of peel seal material. Although not visible in FIG. 4, the side edges of the web 40' are captured in the side seals for the front and rear awalls of the "pillow" package, thereby ensuring that the web 40' is caulked on all sides to hermetically seal the package contents.

FIG. 5 shows a package incorporating the tamper-evident feature of FIG. 3 and an internal hermetic peel seal. The internal hermetic peel seal in this embodiment is provided by hard sealing a proximal edge of a separate web 50 between the zipper flange 40 and the front wall 12, and peel sealing the distal edge of web 50 to the rear wall 14 by means of a layer 48 of peel seal material. Again the side edges of the web 50 must be captured in the side seals for the front and rear walls of the "pillow" package to ensure that the package contents are hermetically sealed.

The preferred material for tacking the slider to the header is a so-called "peel seal" material. Peel seal materials are well known in the art. Alternatively, a peel-sealable laminated film strips or tape may be used. Peelable films of this type are designed to be heat-sealed to themselves or to other films, and to be peeled apart under known, predictable forces. When peeled apart, the separation mechanism is delamination within the peelable film itself. The delamination, which comprises one layer peeling off of its neighboring layer within the film structure, occurs because the bond between the two layers is weaker than the bond between the peelable film and the material to which it is sealed. These films, when peeled open, usually show a frosted white imprint indicating where they had been sealed together.

The present invention is further directed to a method of tamperproofing a package of the types shown in the drawings. In particular, the tamperproofing method applies to a receptacle having a mouth at an upper end, a flexible zipper attached to the mouth, a slider coupled to the zipper, and a header extending upward and having a free end. The method comprises the steps of filling the receptacle with contents while the zipper is open; moving the slider to a closed position to close the zipper; and tacking or adhering the slider to the header while the slider is in the closed position.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A package comprising walls secured together to define a receptacle space having a mouth at an upper end, a flexible zipper attached to said mouth and in a closed state, a slider coupled to said zipper for opening said zipper when said slider is moved along said zipper in a direction of opening, a header panel extending upward and having a free end, and a seal which affixes said slider relative to said header panel, said slider being slidable along said zipper when said seal is broken.

2. The package as recited in claim 1, wherein said seal comprises a layer of peel seal material in contact with said slider and said header panel.

3. The package as recited in claim 1, wherein said seal comprises a layer of adhesive material in contact with said slider and said header panel.

4. The package as recited in claim 1, wherein said seal comprises a peel-sealable laminated film strip.

5. The package as recited in claim 1, wherein said header panel is integrally formed as an extension of one of said walls.

6. The package as recited in claim 1, wherein said zipper comprises first and second interlockable fastener strips, and said header panel is integrally formed as an extension of one of said first and second interlockable fastener strips.

7. The package as recited in claim 1, wherein said header panel is attached to one of said walls.

8. The package as recited in claim 1, wherein said zipper comprises first and second interlockable fastener strips, and said header panel is attached to one of said first and second interlockable fastener strips.

9. The package as recited in claim 1, further comprising an internal hermetic peel seal.

10. A package comprising walls secured together to define a receptacle space having a mouth at an upper end, a flexible zipper attached to said mouth and in a closed state, a slider coupled to said zipper for opening said zipper when said slider is moved along said zipper in a direction of opening, a header panel extending upward and having a free end, and frangible means for affixing said slider relative to said header panel, said slider being slidable along said zipper when said frangible means are broken.

11. The package as recited in claim 10, wherein said frangible means comprise a peel seal.

12. The package as recited in claim 10, wherein said frangible means comprise adhesive.

13. The package as recited in claim 10, further comprising an internal hermetic peel seal.

14. A header bag comprising a receptacle having a mouth at an upper end, a flexible zipper attached to said mouth and in a closed state, a slider coupled to said zipper for opening said zipper when said slider is moved along said zipper in a direction of opening, a header extending upward above said mouth, and a layer of material which holds said slider in a fixed closed position relative to said header until a force exceeding a predetermined threshold is applied.

15. The header bag as recited in claim 14, wherein said layer of material comprises peel seal material.

16. The header bag as recited in claim 14, wherein said layer of material comprises adhesive.

17. The header bag as recited in claim 14, wherein said header extends from one of said walls.

18. The header bag as recited in claim 14, wherein said zipper comprises first and second interlockable fastener strips, and said header extends from one of said first and second interlockable fastener strips.

19. The header bag as recited in claim 14, further comprising an internal hermetic peel seal.

20. A method of tamperproofing a package comprising a receptacle having a mouth at an upper end, a flexible zipper attached to said mouth, a slider coupled to said zipper, and a header extending upward and having a free end, comprising the steps of: filling said receptacle with contents while said zipper is open; moving said slider to a closed position to close said zipper; and tacking or adhering said slider to said header while said slider is in said closed position.

21. The method as recited in claim 20, wherein said tacking or adhering step comprises the step of applying a layer of sticky or adhesive material on a rear external surface of said slider.

22. The method as recited in claim 20, wherein said tacking or adhering step comprises the step of applying a layer of sticky or adhesive material on a surface portion of said header which confronts a rear external surface of said slider in said closed position.

* * * * *